US006623005B1

(12) United States Patent
Tsai

(10) Patent No.: US 6,623,005 B1
(45) Date of Patent: Sep. 23, 2003

(54) GAME PLAYING MEMBER SUPPORTING DEVICE FOR A HOCKEY GAME TABLE

(76) Inventor: Lore Tsai, No.22, Lane 20, Zichiang Street, Taichung City (TW)

( * ) Notice: Subject to any disclaimer, the term of this patent is extended or adjusted under 35 U.S.C. 154(b) by 0 days.

(21) Appl. No.: 10/175,795

(22) Filed: Jun. 21, 2002

(51) Int. Cl.[7] ..... A63F 7/06

(52) U.S. Cl. ..... 273/108.1; 273/108.52; 273/126 R

(58) Field of Search ..... 273/108.1, 108.52, 273/108.53, 108.54, 108.55, 108.56, 126 R, 126 A

(56) References Cited

U.S. PATENT DOCUMENTS 3,113,776 A * 12/1963 Romei ..... 273/108.57
5,046,734 A * 9/1991 Laine ..... 273/108.51
5,433,443 A * 7/1995 Ples ..... 273/108.51
5,655,767 A * 8/1997 Francis et al. ..... 273/108.1
6,189,885 B1 * 2/2001 Hamot ..... 273/108.1
6,450,497 B1 * 9/2002 Bialler et al. ..... 273/108.1
6,478,299 B2 * 11/2002 Bialler et al. ..... 273/108.1

* cited by examiner

*Primary Examiner*—Raleigh W. Chiu
(74) *Attorney, Agent, or Firm*—Troxell Law Office PLLC

(57) ABSTRACT

Game playing member supporting device of hockey game table, including a main body; a transmission mechanism including: a rod section horizontally rotatably fitted through the main body, when pulling the rod section, the main body is driven and displaced; a shaft member upright rotatably fitted through the top face of the main body, top end of the shaft member being connected with a game playing member; when rotating the rod section, via a transmission unit, the shaft member being driven and rotated; and a predetermined number of upper and lower rollers rotatably disposed at front end and/or rear end of the main body. The upper and lower rollers are opposite to each other spaced from each other by a certain distance. The upper and lower rollers are resiliently forced toward each other to provide a resilient clamping force. Accordingly, the supporting device can resiliently clamp a inner board in the table and stably move within the table.

15 Claims, 7 Drawing Sheets

GAME PLAYING MEMBER SUPPORTING DEVICE FOR A HOCKEY GAME TABLE

BACKGROUND OF THE INVENTION

The present invention is related to a game device, and more particularly to a game playing member supporting device of hockey game table, which can be more stably moved within the table.

FIG. 1 shows a conventional hockey game table 10. Multiple game playing members 12 and slot rails 14 are disposed on the table face 11. A player can operate the operation bars 15 disposed on the table 10 to rotate and drive the game playing members 12 to move along the rails 14 so as to simulate a hockey.

Multiple transmission mechanisms 16 are disposed in the table 10 as shown in FIG. 2. Each transmission mechanism 16 has a linking member 18 (which can be a spring or a soft flexible member). The inner end of each operation bar 15 is connected with one end of the linking member 18. The bottom end of the game playing member 12 through the rail 14 is connected with the other end of the linking member 18. When rotating the operation bar 15, the game playing member 12 is driven and rotated via the linking member 18. When pushing or pulling the operation, bar, the game playing member is driven to move along the rail 14. Accordingly, the game playing members is operable to drive a hockey platelet 19.

In the above conventional structure as shown in FIG. 2, the game playing member 12 and transmission mechanism 16 are not well located. As a result, when moving and rotating the game playing member, the game playing member and the transmission mechanism tend to deflect and swing. Therefore, the game playing member can be hardly stably moved and operated. Moreover, the game playing member and transmission mechanism are easy to collide the table face 11 to produce noise.

SUMMARY OF THE INVENTION

It is therefore a primary object of the present invention to provide a game playing member supporting device of hockey game table. The supporting device can be more stably moved within the table to stably drive the game playing member.

It is a further object of the present invention to provide the above game playing member supporting device of hockey game table, which can be stably operated to reduce noise in operation.

The present invention can be best understood through the following description and accompanying drawings wherein:

DETAILED DESCRIPTION OF THE PREFERRED EMBODIMENTS

Figure 1:
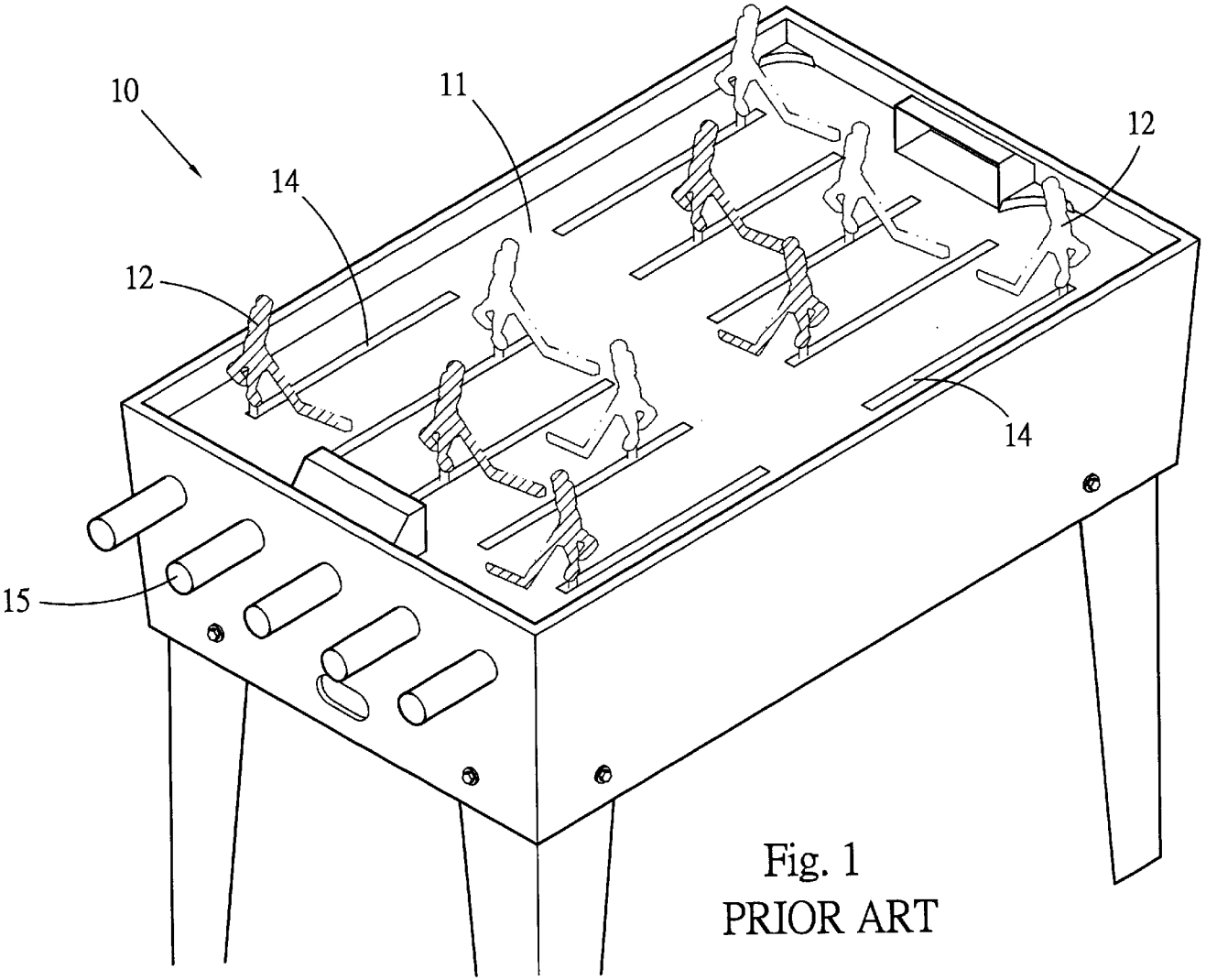
Fig. 1 PRIOR ART
FIG. 1 is a perspective view of a conventional hockey game table.
Figure 2:
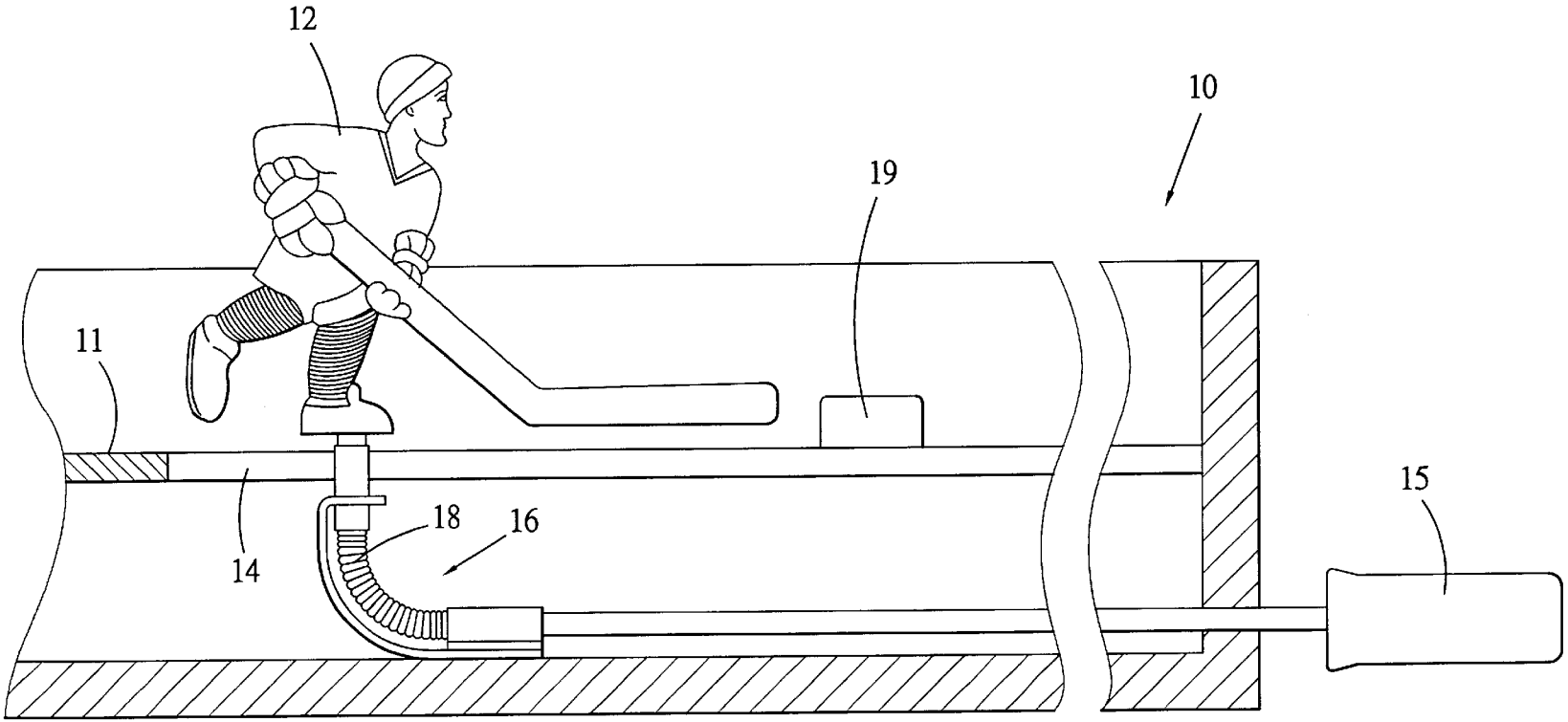
Fig. 2 PRIOR ART
FIG. 2 is a partially sectional view of the conventional hockey game table.
Figure 3:
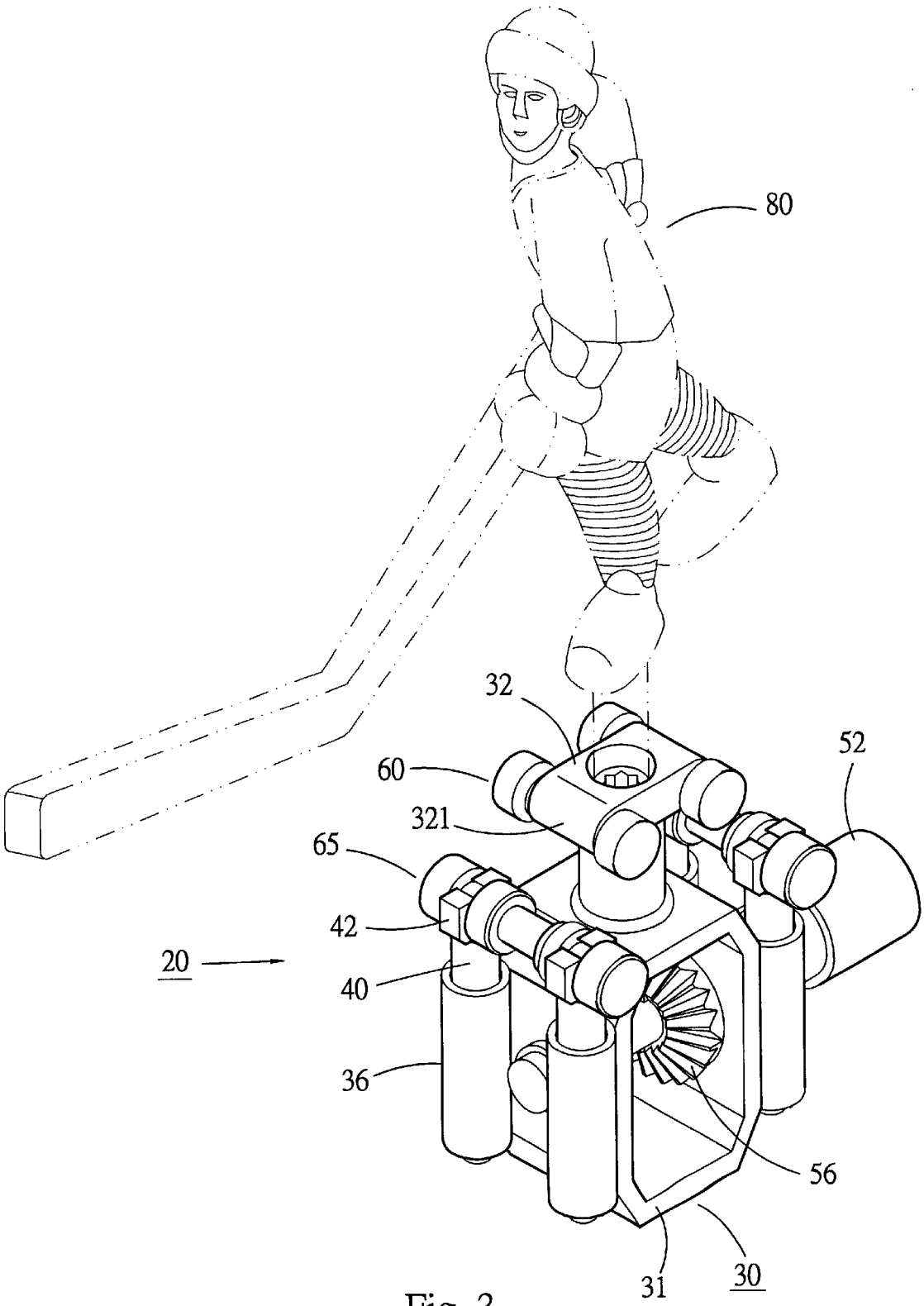
FIG. 3 is a perspective assembled view of a first embodiment of the present invention.
Figure 4:
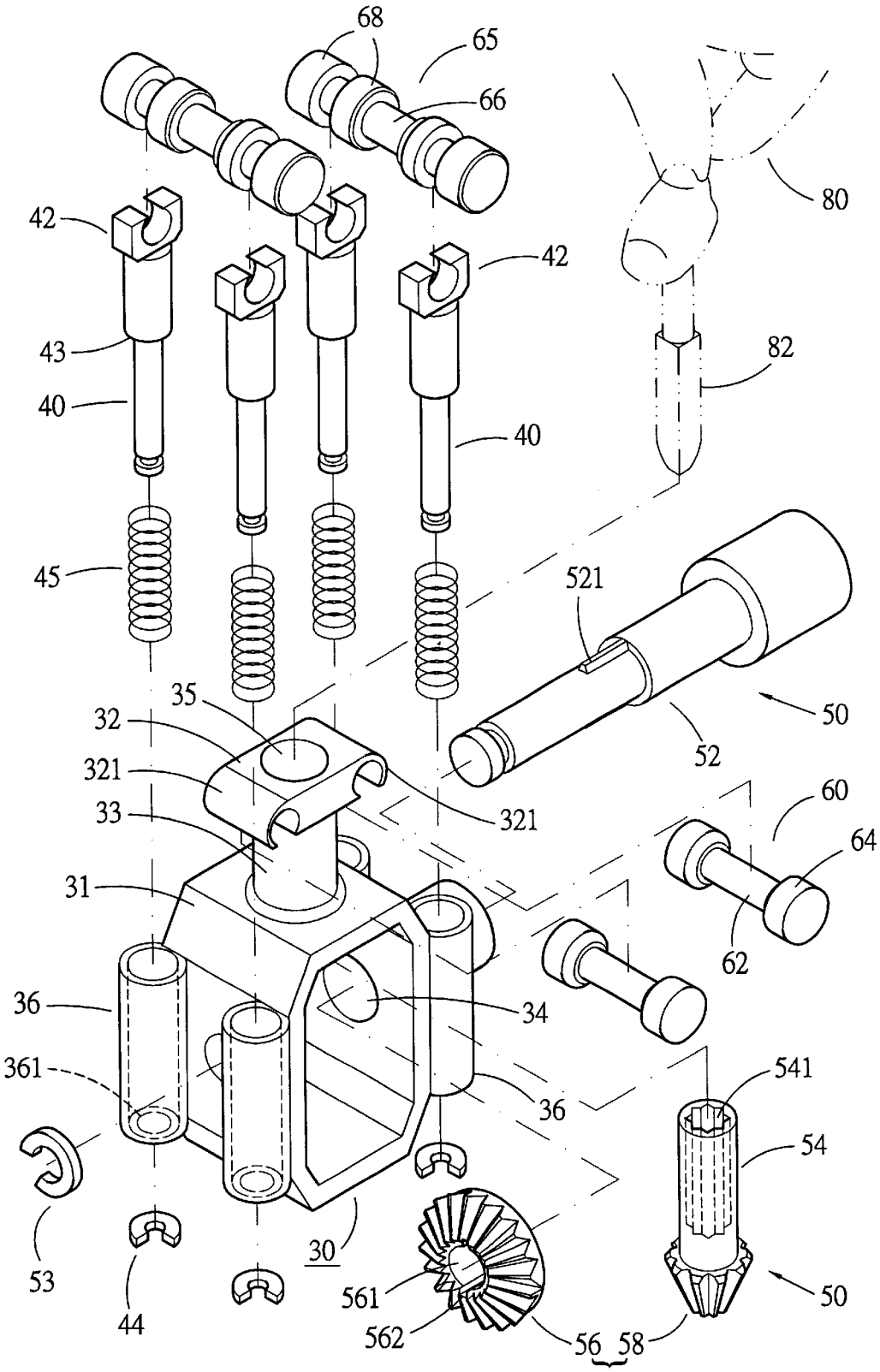
FIG. 4 is a perspective exploded view of the first embodiment of the present invention.

Please refer to FIGS. 3 and 4. According to a first embodiment, the game playing member supporting device 20 of the present invention includes:

A main body 30 having a hollow frame body 31. A stem section 33 upward extends from top face of the frame body 31. A top seat section 32 is disposed at top end of the stem section and spaced from the frame body by a certain distance. A shaft hole 34 is transversely formed through front and rear end faces of the frame body 31. A through hole 35 is upright formed through the top seat section 32, the stem section 33 and the frame body 31. Four tubular holder sections 36 are respectively upright fixed on two sides of the front and rear ends of the frame body 31.

Figure 6:
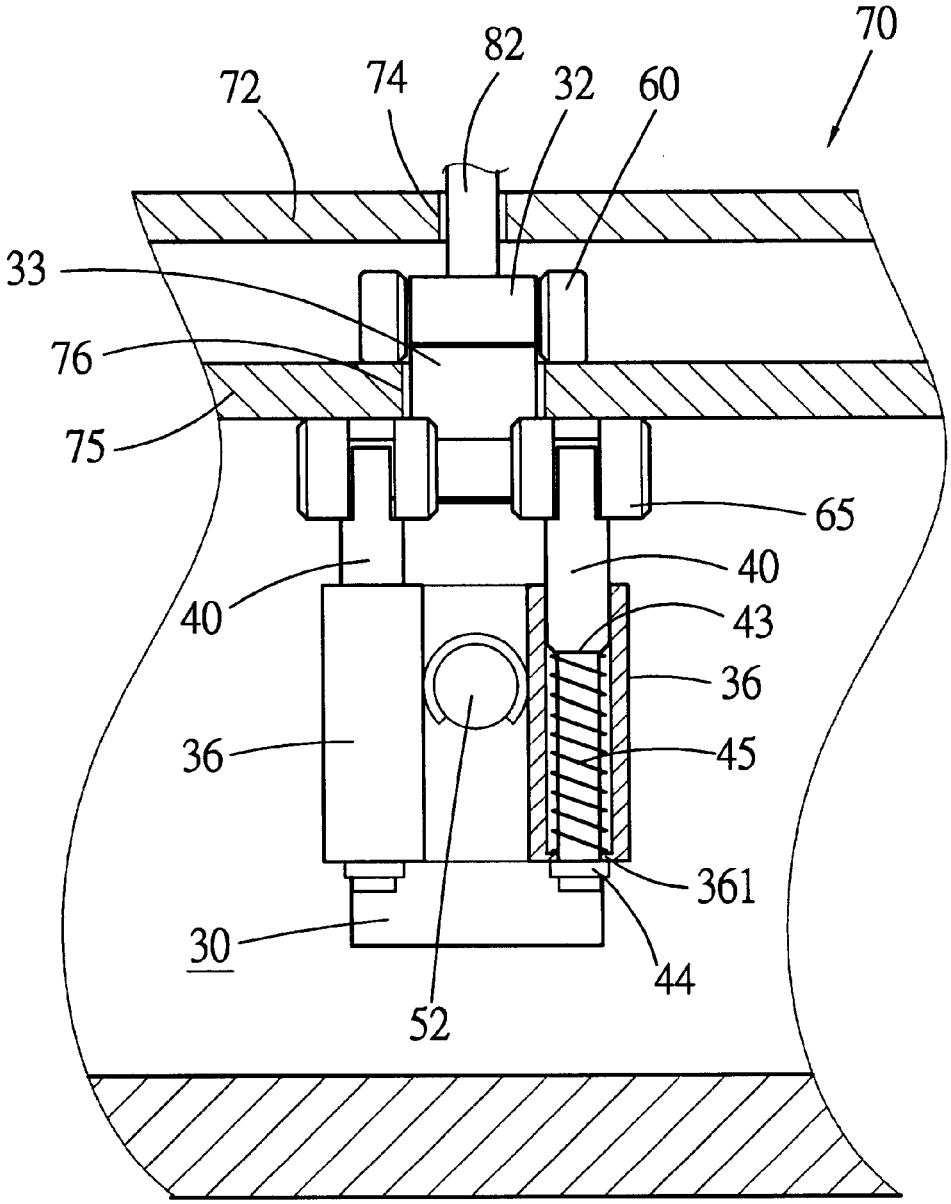
FIG. 6 is a sectional view taken along line 6—6 of FIG. 5.

Four support pins 40, the bottom ends of the four support pins 40 are respectively up and down slidably fitted in the four holder sections 36 as shown in FIG. 6. The top end of each support pin 40 is provided with a pivot section 42. The bottom end of the support pin extends out of the bottom end of the holder section and retained by a C-shaped retainer ring 44 which prevents the support pin from upward detaching from the holder section 36.

Four resilient members such as springs 45 are respectively accommodated in the four holder sections 36 and fitted around the support pins 40 as shown in FIG. 6. The top end of each spring 45 abuts against a shoulder section 43 of the support pin. The bottom end thereof abuts against an inner flange 361 of bottom end of each holder section. The spring provides a resilient force for the support pin, whereby when the support pin does not suffer external force, the support pin is kept sliding upward. When the C-shaped retainer ring 44 abuts against the bottom end of the holder section 36, the support pin is positioned at an upper dead end.

A transmission mechanism 50 including a rod section 52, a shaft member 54 and a transmission unit 55.

The rod section 52 can be an inner end of an operation bar of the hockey game table. In this embodiment, the rod section 52 is a separate member connected with the operation bar. The rod section 52 is rotatably fitted through the shaft hole 34 of the main body 30. A C-shaped retainer ring 53 is fixed at rear end of the rod section 52 to locate the same. The rear end and rod body of the rod section respectively abut against the front and rear end faces of the main body, whereby the main body can be driven and moved.

The shaft member 54 is rotatably fitted through the through hole 35.

The transmission unit 55 is disposed between the rod section 52 and the shaft member 54, whereby the rod section 52 and the shaft member 54 can be synchronously rotated. The transmission unit 55 can be a flexible member such as a spring. Alternatively, in this embodiment, the transmission unit 55 includes two bevel gears 56, 58 which are respectively integrally formed with the rod section 52 and the shaft member 54 or are separate members. In this embodiment, the first gear 56 is a separate member fitted around the rod section 52 and positioned in the main body 30. The inner circumference of the gear 56 around the inner hole 561 thereof is formed with two channels 562. The rod section 52 is formed with two ribs 521 engaged in the channels 562, whereby the gear 56 is synchronously rotatable along with the rod section. The second gear 58 is fixedly disposed at bottom end of the shaft member 54 and positioned in the main body 30. The second gear 58 meshes with the first gear 56.

Two upper rollers 60 each having a shaft section 62. The shaft sections 62 of the upper rollers are respectively inlaid and latched in the clip sections 321 formed at front and rear ends of the top seat section 32. Therefore, the upper rollers 60 are rotatably disposed on the top seat section and the wheel sections 64 of the upper rollers 60 can be rotated.

Two lower rollers 65 each having a shaft section 66 and several wheel sections 68 disposed on the, shaft section 66. The shaft sections 66 of the lower rollers 65 are respectively inlaid and latched in the pivot sections 42 of top ends of the support pins 40. Therefore, the lower rollers 65 are rotatable on the top ends of the support pins. After mounted, the lower rollers 65 and upper rollers 60 are opposite to each other and spaced by a certain distance.

Figure 5:
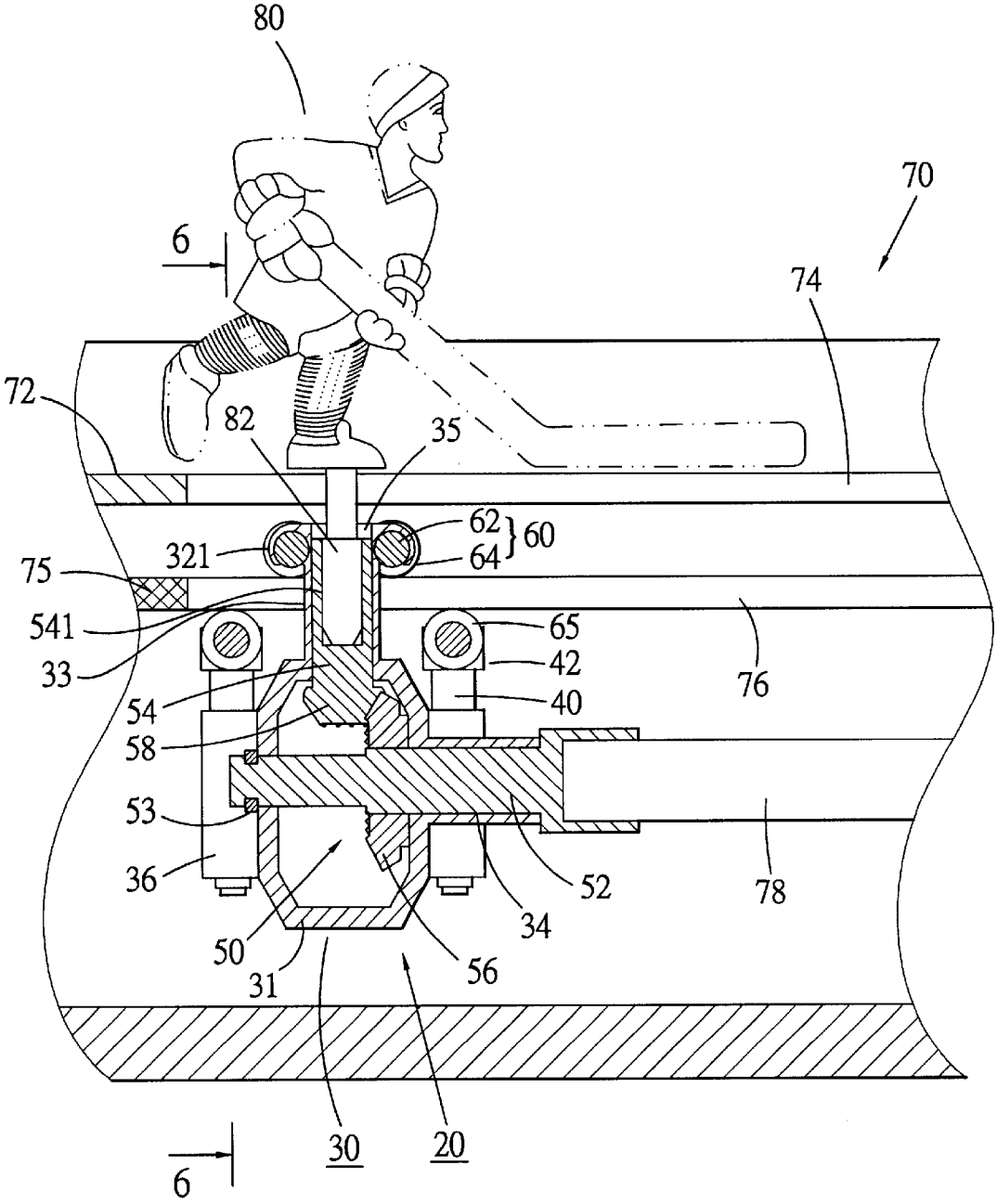
FIG. 5 is a partially sectional view showing that the present invention is mounted in the hockey game table.

After assembled as shown in FIG. 3, the present invention is mounted in the hockey game table 70 as shown in FIGS. 5 and 6. Each supporting device 20 is connected with a game playing member 80.

As shown in FIGS. 5 and 6, a partitioning board 75 is additionally disposed under the table face 72 of the hockey game table 70. The partitioning board is formed with a slot 76 under each rail 74.

The supporting devices 20 are disposed in the table 70 under the table face 72. The upper and lower rollers 60, 65 respectively clamp the top and bottom faces of the partitioning board 75 as shown in FIGS. 5 and 6. The stem section 33 is positioned in the slot 76. The inner ends of the operation bars 78 are respectively fixedly connected with outer ends of the rod sections 52 for operating the support devices as shown in FIG. 5. An insertion section 82 of bottom end of the game playing member 80 is passed through the rail 74 and inserted in the insertion hole 541 of top end of the shaft member 54 so as to connect the game playing members with the shaft member. The game playing member is positioned on outer side of the table face 72. It should be noted that the shaft member 54 can be alternatively integrally formed at bottom end of the game playing member.

In use, when pushing or pulling the operation bar 78, the supporting device 20 is driven and moved along the rail 74 and the slot 76, whereby the game playing member 80 is driven and displaced. The rollers 60, 65 roll on the partitioning board 75 in a direction of the displacing direction of the supporting device.

When rotating the operation bar 78 to rotate the rod section 52, by means of the engagement between the two gears 56, 58, the shaft member 54 is driven and rotated. Therefore, the game playing member 80 can be rotated to drive the platelet on the table face 72.

Figure 7:
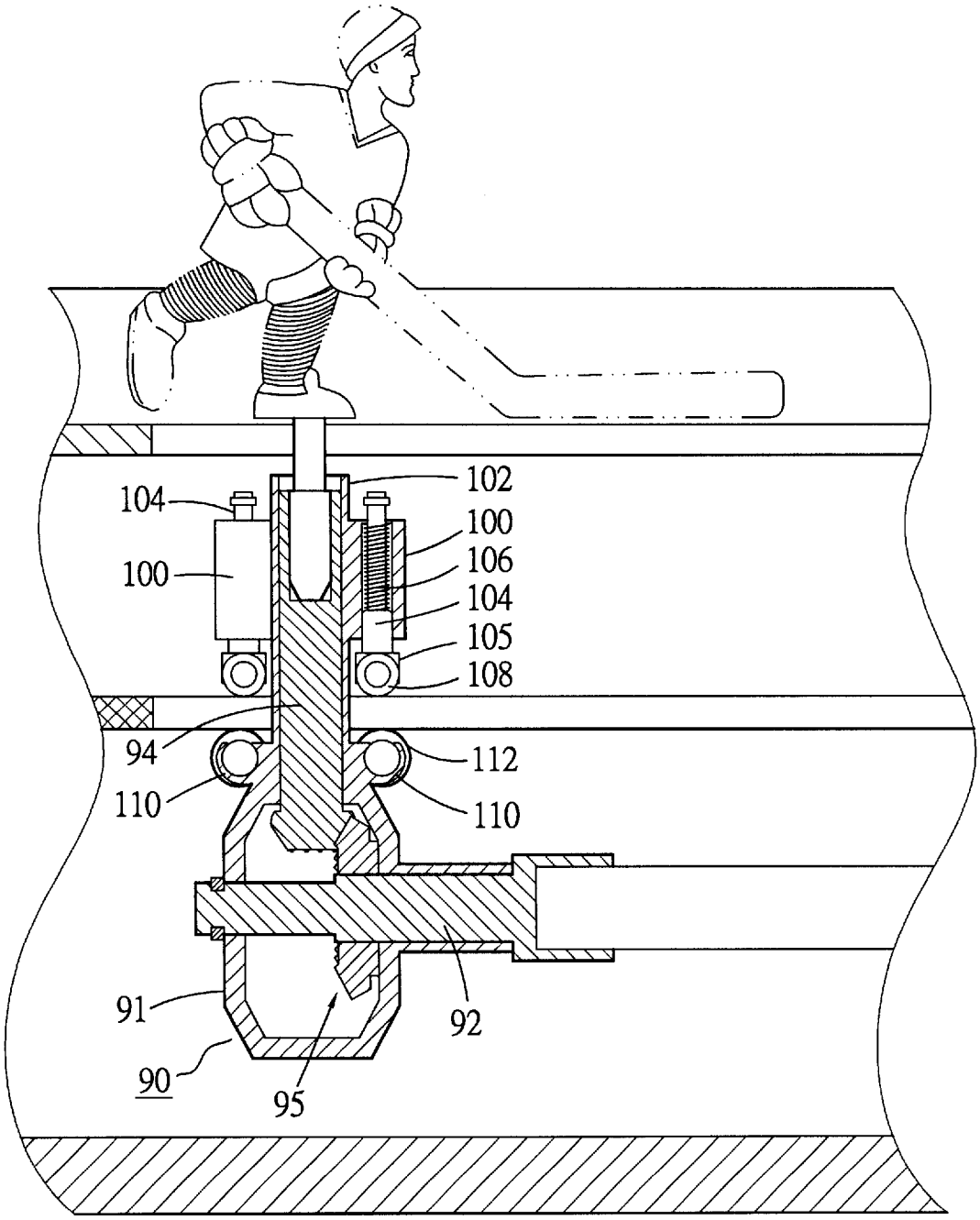
FIG. 7 is a partially sectional view of a second embodiment of the present invention.

FIG. 7 shows another embodiment of the present invention, in which the main body 90, rod section 92, shaft member 94 and transmission mechanism 95 are identical to those of the first embodiment.

The second embodiment is different from the first one in that the holder sections 100 are disposed at front and rear ends of the top seat section 102. The four support pins 104 are respectively upward fitted into the holder sections 100. The resilient members 106 serve to keep the support pins 104 downward moving. The upper rollers 108 are rotatably disposed in the pivot sections 105 of bottom ends of the support pins 104. The top edges of front and rear end faces of the frame body 91 of the main body 90 are respectively formed with two clip sections 110. The lower rollers 112 are rotatably disposed in the clip sections 110. The upper and lower rollers 108, 112 are also spaced from each other by a certain distance. Accordingly, the rollers 108, 112 also resiliently clamp the partitioning board. The upper rollers of the second embodiment provide resilient clamping force instead of the lower rollers of the first embodiment.

Alternatively, teaching by the embodiments, both the upper and lower rollers can provide resilient clamping force.

The present invention is advantageous in that the supporting device is stably mounted in the table by the way of resilient clamp. Therefore, the supporting device can be stably moved without swinging or deflecting. Accordingly, the operation is stabilized. Moreover, both the supporting device and the game playing member will not collide the table so that the noise is reduced.

The above embodiments are only used to illustrate the present invention, not intended to limit the scope thereof. Many modifications of the above embodiments can be made without departing from the spirit of the present invention.

What is claimed is:

1. A game playing member for a hockey game table, comprising:

a hollow main body, a shaft hole being formed through front and rear end faces of the main body, a through hole being upright formed through a top face of the main body;

a transmission unit including:

a rod section horizontally rotatably fitted through the shaft hole, whereby when pushing or pulling the rod section, the main body is driven and displaced;

a shaft member upright rotatably disposed in the through hole, a top end of the shaft member being connected with a doll;

a transmission unit disposed in the main body and connected with the rod section and the shaft member, when rotating the rod section, via the transmission unit, the shaft member is driven and rotated;

at least one upper roller rotatably disposed on upper side of front end and/or rear end of the main body and able to roll; and at least one lower roller rotatably disposed at front end and/or rear end of the main body opposite to the upper roller, the upper and lower rollers being spaced from each other by a certain distance, the upper and lower rollers being resiliently forced toward each other to provide a resilient clamping force.

2. A game playing member for a hockey game table as claimed in claim 1, wherein the lower roller has a resilient upward moving force.

3. A game playing member for a hockey game table as claimed in claim 1, wherein the upper roller has a resilient downward moving force.

4. A game playing member for a hockey game table as claimed in claim 1, wherein the lower roller has a resilient upward moving force, while the upper roller has a resilient downward moving force.

5. A game playing member for a hockey game table as claimed in claim 1, wherein the end of the main body at which the lower roller is disposed is provided with at least one upright tubular holder section, the holder section being positioned under the upper roller, at least one support pin being up and down slidably fitted in the holder section without upward detaching out of the holder section, a top end of the support pin being formed with a pivot section, at least one resilient member being disposed between the holder section and the support pin to resiliently keep the support pin upward moving, the lower roller being rotatably disposed in the pivot section.

6. A game playing member for a hockey game table as claimed in claim 5, wherein the support pin is formed with a shoulder section under the pivot section, the bottom end of the holder section being formed with an inner flange with smaller inner diameter, the resilient member being a spring fitted around the support pin, two ends of the spring respectively abutting against the shoulder section and the inner flange.

7. A game playing member for a hockey game table as claimed in claim 5, wherein the portion of the main body on which the upper roller is disposed is formed with a clip section, the upper roller being rotatably disposed in the clip section.

8. A game playing member for a hockey game table as claimed in claim 1, wherein the end of the main body at which the upper roller is disposed is provided with at least one upright tubular holder section, the holder section being positioned above the lower roller, at least one support pin being up and down slidably fitted in the holder section without downward detaching out of the holder section, a bottom end of the support pin being formed with a pivot section, at least one resilient member being disposed between the holder section and the support pin to resiliently keep the support pin downward moving, the upper roller being rotatably disposed in the pivot section.

9. A game playing member for a hockey game table as claimed in claim 8, wherein the support pin is formed with a shoulder section above the pivot section, the top end of the holder section being formed with an inner flange with smaller inner diameter, the resilient member being a spring fitted around the support pin, two ends of the spring respectively abutting against the shoulder section and the inner flange.

10. A game playing member for a hockey game table as claimed in claim 8, wherein the portion of the main body on which the lower roller is disposed is formed with a clip section, the lower roller being rotatably disposed in the clip section.

11. A game playing member for a hockey game table as claimed in claim 1, wherein the main body includes a hollow frame body and a top seat section disposed on upper side of the frame body, the shaft hole being formed through the frame body, the through hole being formed through the top seat section and the frame body, the upper roller being rotatably disposed at front end and/or rear end of the top seat section, the lower roller being rotatably disposed at front end and/or rear end of the frame body.

12. A game playing member for a hockey game table as claimed in claim 11, wherein the end of the frame body at which the lower roller is disposed is provided with at least one upright tubular holder section, at least one support pin being up and down slidably fitted in the holder section, a top end of the support pin being formed with a pivot section, at least one resilient member being disposed between the holder section and the support pin to resiliently keep the support pin upward moving, the lower roller being rotatably disposed in the pivot section.

13. A game playing member for a hockey game table as claimed in claim 11, wherein the end of the top seat section at which the upper roller is disposed is provided with at least one upright tubular holder section, at least one support pin being up and down slidably fitted in the holder section, a bottom end of the support pin being formed with a pivot section, at least one resilient member being disposed between the holder section and the support pin to resiliently keep the support pin downward moving, the upper roller being rotatably disposed in the pivot section.

14. A game playing member for a hockey game table as claimed in claim 11, wherein the bottom face of the top seat section is connected with the top face of the main body via a stem section.

15. A game playing member for a hockey game table as claimed in claim 1, wherein the transmission unit includes a first and a second bevel gears, the first bevel gear being concentrically disposed on the rod section, the second bevel gear being concentrically disposed on the shaft member, the first and second bevel gears meshing with each other.

* * * * *